US005095690A

United States Patent [19]

Busch et al.

[11] Patent Number: 5,095,690

[45] Date of Patent: Mar. 17, 1992

[54] METHOD AND DEVICE FOR EXCHANGE OF FULL THREAD PACKAGES

[75] Inventors: Rainer Busch, Effretikon; Ludek Malina, Kloten; Andre Lattion, Seuzach, all of Switzerland

[73] Assignee: Maschinenfabrik Rieter AG, Winterthur, Switzerland

[21] Appl. No.: 507,988

[22] Filed: Apr. 11, 1990

[30] Foreign Application Priority Data

Apr. 14, 1989 [CH] Switzerland ..... 1413/89

[51] Int. Cl.[5] ..... D01H 9/00; D01H 9/14

[52] U.S. Cl. ..... 57/275; 57/276; 57/266

[58] Field of Search ..... 57/266-271, 57/273-278, 281, 299

[56] References Cited

U.S. PATENT DOCUMENTS 993,565 5/1911 Stell et al. ..... 57/267
1,351,701 8/1920 Smith, Jr. ..... 57/267
1,639,968 8/1927 Rhodes et al. ..... 57/267
3,813,870 6/1974 Viglione ..... 57/266
4,036,001 7/1977 Tamai et al. ..... 57/274
4,843,809 7/1989 Krawietz ..... 57/267

*Primary Examiner*—Daniel P. Stodola
*Assistant Examiner*—Michael R. Mansen
*Attorney, Agent, or Firm*—M. Lawrence Oliverio

[57] ABSTRACT

In the donning and doffing operation of a spinning machine, a tube (20) is pushed onto a packaged tube (14), whereby the thread (7) remains unbroken. The package (14) and the tube (20) are rotated together, until a few turns of the thread (7) are wound on to the tube (20). The tube (20) is subsequently held and the packaged tube containing the package (14) is removed. Subsequently, the empty spindle (15) is guided into the tube (20) for subsequent spinning operations without the necessity for removing overwindings which normally occur.

18 Claims, 3 Drawing Sheets

METHOD AND DEVICE FOR EXCHANGE OF FULL THREAD PACKAGES

BACKGROUND OF THE INVENTION

The invention relates to a process and a device for the exchange of full thread packages for thread bobbins (or tubes) on spinning machines with spindles, and more particularly to processes and devices for obviating the necessity for removing excess thread coilings which normally occur during doffing and donning operations in yarn or thread spinning machines, particularly in connection with cap spinning machines.

Before the doffing of full thread packages, also called cops, underwinding crowns frequently occur in spinning machines. Such thread windings or thread coilings located underneath the crown must eventually be removed. A typical method for removing such underwound coils is to rub them off by means of a bar with abrasive paper or the like which is swiveled against the underwinding part during a subsequent spinning process. A consequence of such a process is that fly is generated permeating the air in the spinning room which is onerous for spinning machine operating personnel and injurious to health. Another typical means of removing such underwindings involves the use of a robot moving along the machine for removing superfluous thread windings through such means as scratching, cutting and suction. Typically such robots are dedicated to this one function, so that considerable additional expense is incurred for coordination with other robots performing other needed functions such as piecing.

The presence of a spinning cap results in particular problems when doffing cap spinning machines. An underwind crown would not be practical with such machines. One doffing method makes use of an inserted or plugged-in attachment in the upper end of the tube, on which an overwinding is wound. The attachment is transferred from a full package to a new (empty) tube either manually or mechanically. One disadvantage is having to clean the attachment. As the attachment must remain on the tube during spinning, precautions must be taken to ensure a reliable but detachable connection between the tube and the attachment. The possibility exists nevertheless, because sufficiently reliable tube connections are not available, that the attachment may get out of control at normal rotational speeds, typically up to as much as 20,000 rpm and above, presenting a potential danger for operating personnel and potential damage to machine parts.

It is, therefore, an object of the present invention to provide a method and a device for doffing and exchanging full thread packages, particularly in connection with cap spinning machines, which overcomes the disadvantages previously mentioned particularly those involving danger to man or machine and difficulties in removing thread residues.

SUMMARY OF THE INVENTION

Figure 1A:
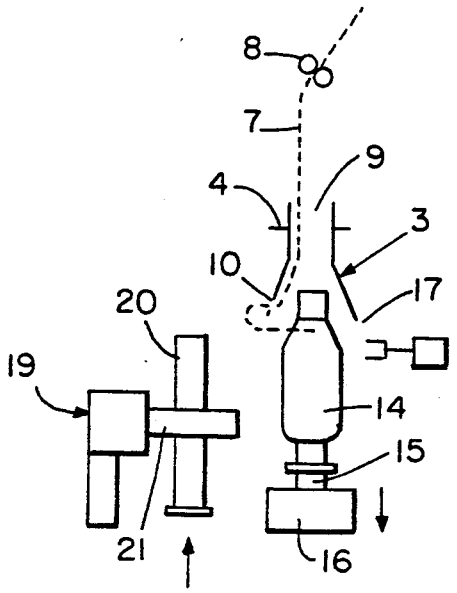
FIGS. 1A–1J are semi schematic side view representations of a typical succession of stepwise movements of an apparatus and method according to the invention whereby doffing, donning and exchange of empty tubes and packages in a thread spinning machine is effected.

The present invention is described hereafter with reference to the drawings showing one preferred embodiment in connection with a cap spinning machine. In a typical cap spinning machine, a thread 7 emerges from a drafting mechanism, the last set of rollers of which is designated as 8 in FIG. 1A. The thread 7 is routed through a cap 3 and onto a bobbin or tube 20 which is detachably affixed on a driven spindle 15. During a normal spinning operation, a thread receiving tube 20 is disposed within the cavity of the cap 3 in a position such as shown in FIG. 1J. As the tube 20 is driven by the spindle 15 (typically, as mentioned above, at speeds of up to as much as 20,000 rpm and above), the thread 7 is spun together with the tube 20. The portion of the spinning thread 7 extending between the top and the bottom 17 of the cap 3 frictionally engages the interior surface of the cap 3 during spinning and causes the cap 3 to also rotate. As is known in the art, the vast majority of the spinning causes the thread 7 to be twisted and a relatively small portion of the high speed spinning is devoted to wrapping the thread 7 around the take up tube 20. Typically, a plurality of spindles 15 are disposed in horizontal series on a spindle bearing plate 16 which extends the length of a larger spinning machine.

As a spindle bearing plate 16 can typically execute a vertical stroke over a substantial length of a tube 20, it is preferred to increase the length of the vertical stroke of the spindle bearing plate 16 downwards in connection with achieving the invention. As empty exchange tubes 20 are typically held in readiness for subsequent exchange vertically beneath the spindle bearing plate 16, the arrangement of new tubes 20 must be moved outwards or laterally beyond the spindle bearing plate 16. Alternatively, the caps 3 could be rendered vertically adjustable. In such an embodiment, at least one thread guide, preferably folding when necessary, would normally be required between the delivery rollers 8 of the drafting arrangement and the inlet 9 (or top) of the caps 3. Such a vertically upwards displacement of the caps 3, would normally involve an increment in the overall height of the machine and is thus less preferred. Gripping devices employed for the feeding and removal of tubes and full packages in conventional spinning such as a conventional cutting doffer are preferably integrated for use with cap spinning machine also whereby it is unimportant whether the doffer rail undertakes a vertical horizontal movement or carries out a swinging movement on a lower swivel line. Most preferably, in order to simplify stroke regulation of the doffer rail, vertical movements in the doffing procedure are effected by the spindle bearing plate 16, inasmuch as the spindle bearing plate 16 is provided with certain vertical movement capability in any event.

Empty tubes 20 must be connected with a full tube or package 14 such that they are periodically detachable. One tube design suitable for use here is disclosed in our Swiss application No. 01 413/89-0, the disclosure of which is incorporated herein by reference, and is suitable at spinning speeds over 20,000 rpm as a result of its novel fastening capability on the spindle. A preferred adaptation of such a tube for use in connection with the present invention includes a top shoulder portion 40 better enabling engagement of an empty tube 20 on to a package 14. A push on or pressure fitting between the empty tube 20 and the tube 20 with the package 14 on it is preferable at least relative to a magnetic fitting, for example.

A tube holding mechanism 28 for temporarily holding an empty tube 20 in readiness for replacement on a spindle 15 is preferably also provided in connection with the inventive apparatus and method. Such device is preferably disposed for swiveling around a point or line 30 behind the cap mechanism 3.

DETAILED DESCRIPTION EXEMPLARY PREFERRED EMBODIMENTS

FIG. 1A shows a side view positioning of a doffing, donning assembly relative to a fully loaded tube or package sitting on a spindle 15 in a cap spinning machine at a time toward the beginning of a doffing/donning cycle. A cap mechanism 3 of the spinning machine is preferably held vertically static but rotatable by means of a bearing 4. The thread 7, shown as a continuous dashed line, leads from the pair of delivery rollers 8 of a conventional drafting assembly (not shown) through the entry 9 and an outlet 10 of the cap 3 (or, typically, a stirrup in the inside of the cap 3, not shown) to the upper portion of a fully wound, stationary thread package 14, also known as a cop. As is known to a person skilled in the art, a cap spinning machine typically includes a plurality of spindles 15, caps 3, drafting mechanisms, gripping devices 19 and associated mechanisms extending in serial array, typically in linear fashion, along an extended length of a larger spinning machine. The packages 14 are fixed on spindles 15 and collectively fitted on a spindle bearing plate 16 which is adjustable in height. The course of the thread 7 between the rim 17 of the cap 3 and the package 14 is approximately horizontal as shown in FIG. 1A. A gripping device 19, typically a conventional cutting doffer, holds a row of empty thread receiving tubes 20 by means of a plurality of grippers 21 typically in a horizontally arranged state of readiness.

Figure 1B:
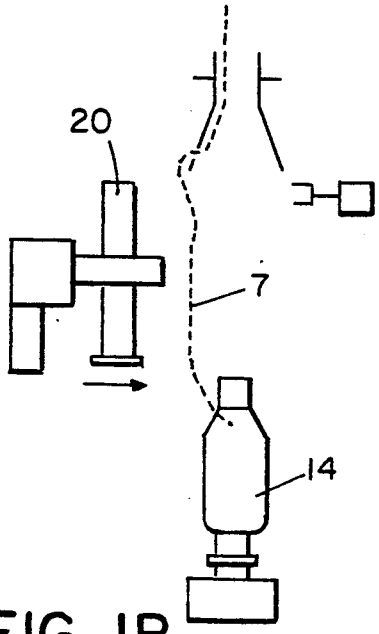
Figure 1C:
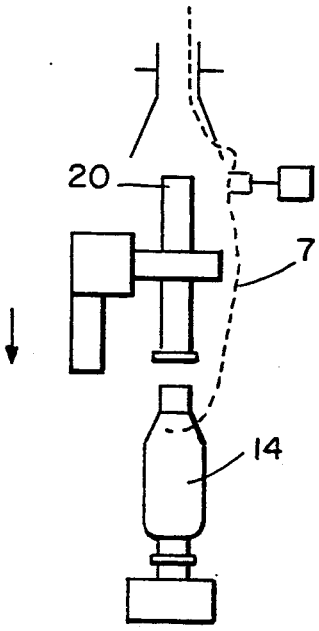

FIG. 1B represents a position where the spindle bearing plate 16 has been lowered far enough to enable a tube 20 to be guided between the rim 17 of the cap 3 and the upper end of the tube 20 of the package 14. The thread 7 is automatically unwound from the package 14 with the vertical downwards movement of the spindle bearing plate 16, without breaking the thread 7. As shown in FIG. 1C, the gripping device 19 next arranges the tubes coaxially with the packages 14, whereby the section of thread 7 between the rim 17 of the cap 3 and the package 14 is rotated or moved to dispose the section of the thread 7 extending between the rim 17 and the package 14 to the opposite side of the grippers 21, if necessary, to avoid the risk of a thread break during coaxial tube alignment. A conventional mechanism (not shown) such as a controllably driven roller or wheel is typically provided for controllably turning cap 3 from a position shown in FIG. 1B to a position as shown in FIG. 1C.

Figure 1D:
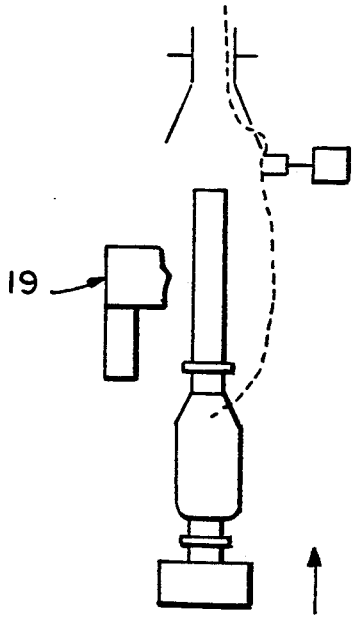
Figure 1E:
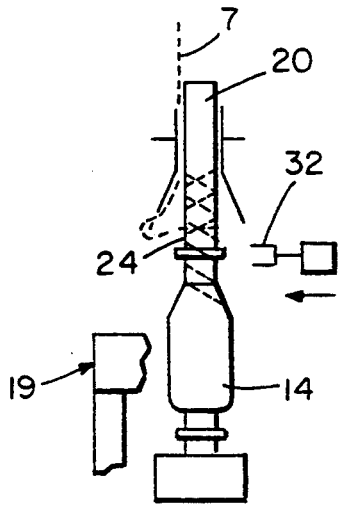

As mentioned above, either the gripping device 19 can be lowered or, more preferably, the spindle bearing plate 16 can be slightly lifted, FIG. 1D in order to engage or fit empty tubes 20 onto the tubes of packages 14. The gripping device 19 releases the tubes 20 upon their engagement with the tubes of packages 14. Gripping device 19 may be returned to a lower position as shown in FIG. 1E in readiness for subsequent gripping of packages 14. Tube 20 and the package 14 are next typically rotated together, until a sufficient number of turns of the thread 7 have been wound over the tube 20, FIG. 1E. Typically during this rotation, the spindle bearing plate 16 is guided vertically upwards until it reaches a position where the rim 17 of the cap 3 is approximately at the same height as a lower predetermined end of the new tube 20 on which the thread 7 is to be newly wound. Through this slow turning of the package 14 (via the driven spindle 15) and the upwards movement of the thread 7 itself, the thread 7 is first wound upwards and subsequently downwards on the tube 20, so that a specified length of thread corresponding to the length of thread unwound during the operation described with reference to FIG. 1B is wound onto the new empty tube 20, FIG. 1E. If during such rewinding the package 14 continues to spin by virtue of residual spinning momentum, then the cap 3 is simply carried along with the slowly rotating package 14 and tube 20, resulting in a little more twist in the core of the thread 7 over a relatively small section of the thread 7. The length, over which the cross winding 24 takes place is typically controlled through a selected stroke movement of the spindle bearing plate 16 and the rotational speed of the package 14 such that this crosswinding 24 is mainly formed in the lower length of the tube 20.

Figure 1F:
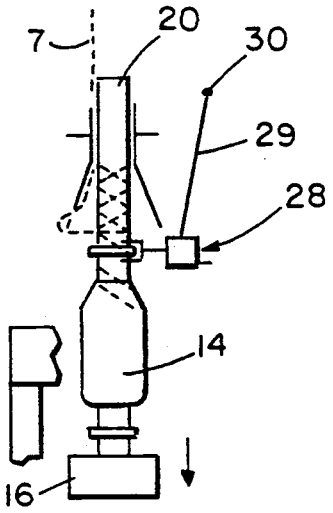
Figure 1G:
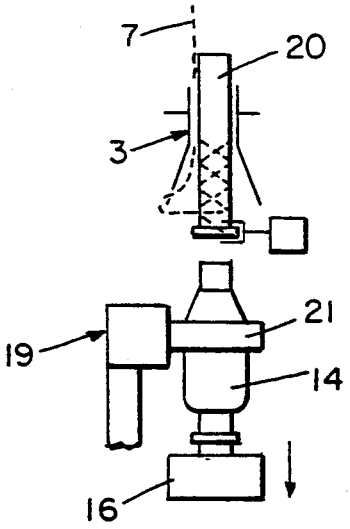
Figure 1H:
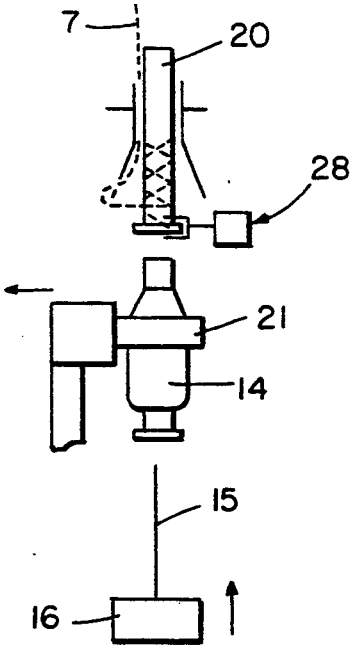

A holding device 28, or a holding beam extending the length of the spinning machine, pivots by means of rods 29 swiveling around point (or line) 30 disposed behind the cap 3 relative to grippers 21 which are disposed in front of cap 3, packages 14, spindle 15 and bearing 16. The swiveling point 30 is also typically a swiveling line running horizontally parallel to beam 28. The holding device 28 is swiveled forwards, FIG. 1F, whereby holders 32 respectively grip and hold a tube 20. A typical alternative for holding tubes 20 comprises the use of a holding device in the neck area of cap 3. The spindle bearing plate 16 is subsequently lowered far enough to enable package 14 to come out of engagement with the tube 20. The grippers 21 of the gripping device 19 simultaneously grip the packages 14, in the middle of the full package 14, FIG. 1F, with the holding device 28 at the projecting rim, and move downwardly together with the bearing plate 16 disengaging the package 14 from the new tubes 20. Otherwise the gripping device 19 remains stationary. The spindle bearing plate 16 is lowered further, FIG. 1G, until the spindles 15 are disposed entirely under the packages 14, FIG. 1H. The gripping device 19 subsequently removes the packages 14 sideways, FIGS. 1H, 1I. Through this, the thread 7 is broken, if it has not already been broken during disengagement of the package 14 from the tube 20, FIGS. 1F, 1G. Thus, thread overwindings or thread residues which would normally occur are eliminated and the necessity for providing apparatus to remove such excess windings and fly resulting therefrom (during removal operations) is obviated.

Figure 1I:
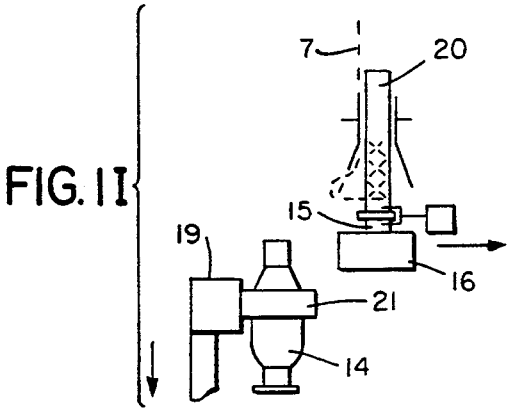
Figure 1J:
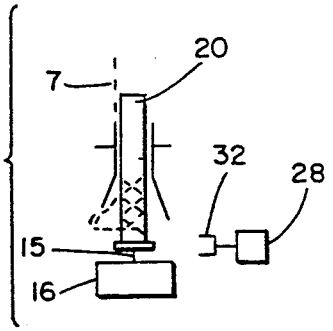

After the package 14 has been removed from alignment with new coaxial tube 20, the spindle bearing plate 16 is lifted again, FIG. 1I, and the new tube 20, which is still held by the holding device 28, is placed or fixed on the spindle 15. The holding device 28 is then swiveled back, FIG. 1J, into its position of readiness for subsequent tube exchange operation. Normal spinning can be restarted upon completion of this package removal and tube exchange operation.

Figure 2:
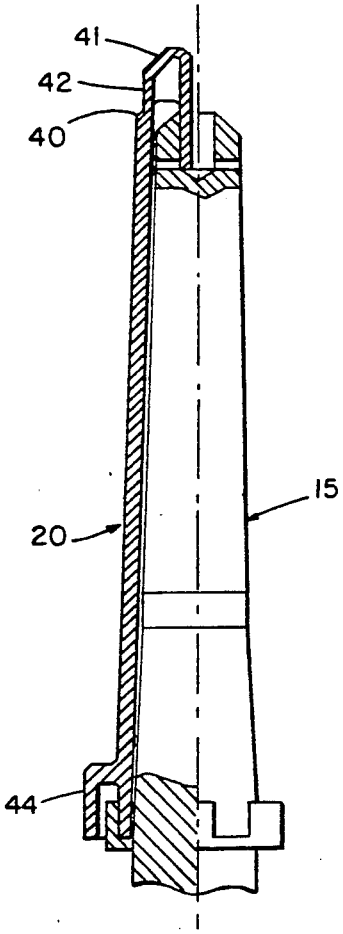
FIG. 2 is a side, partial cross-sectional view of a typical thread receiving tube detachably affixed or mounted on a spindle.

Any conventional method and mechanisms may be employed for detachable engagement of tubes 20 as described with reference to the operations shown in FIGS. 1C, 1D, 1E, 1F, 1G. In one preferred embodiment, the tubes 20 are configured (typically conical) to have an open lower end which is slightly larger in diameter than the upper end such that the upper end 42 of one tube is pressure fittable into the lower end of another tube, FIG. 2. The upper end 42 of a tube 20 is preferably provided with a shoulder 40 and bevel 41 to facilitate the upper portion 42 of one tube 20 being inserted into and engaged with (e.g. presume fittable into) the lower end of another tube 20, FIGS. 1C, 1D. The tubes 20 are engaged with sufficient pressure fitting by virtue of the above described insertion so as to enable the tubes to spin together but also so as to allow the tubes 20 which are engaged to be readily detached or disengaged during the operations described above with reference to FIGS. 1F, 1G. For purposes of enabling ready engagement of tubes 20, the shoulder portion 40 of the tubes 20 may be provided with a corrugated, serrated or ribbed surface as shown, for example, in GB-PS 10 85 435, the disclosure of which is incorporated herein by reference. Alternatively, spikes or adhesive burr strip might also be provided to effect ready engagement.

Figure 3A:
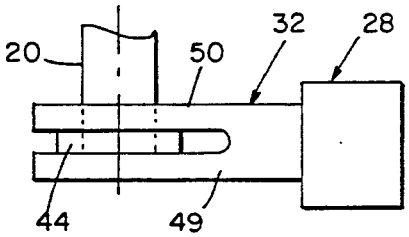
FIG. 3A is a side view of a typical tube holding mechanism in holding engagement with a tube.
Figure 3B:
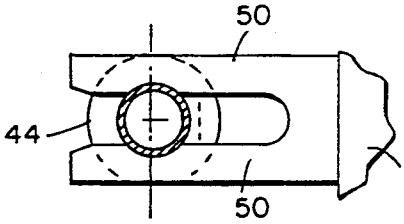
FIG. 3B is a top view of a tube holding mechanism in holding engagement with a tube.

Similarly, any conventional mechanisms/methods may be employed for gripping and holding an empty tube 20 during the disengagement and holding operations described with reference to FIGS. 1E, 1F, 1G, 1H, 1I, 1J above. Typically the tubes 20 are provided with a flange 44, FIGS. 2, 3A, 3B, to be gripped by holder 32 of device 28. Upon swiveling of device 28, FIGS. 1E, 1F, the bottom surface of flange 44 is gripped by lips 49 and the top surface of flange 44 is clamped by limbs 50 with the entire body of flange 44 thus being clamped between lips 49 and limbs 50. Typically lips 49 and limbs 50 comprise a unitary body of rigid, resiliently deformable plastic material. As shown in FIGS. 3A, 3B holding mechanism 32 comprises a limb 50 which extends over a portion of and clamps down on the top surface 42 of flange 44. An opposing upward force is exerted by projecting lips 49 on the bottom surface 43 of flange 44 such that flange 44 is effectively grasped by holder 32. As shown, a spacing is provided between lips 49 to enable lips 49 to skirt around the circumference of the tube 20 on which the tube 20 to be grasped is positioned. As can be readily imagined, holder 32 may assume a variety of configurations. One alternative, for example, may be such that limb 50 comprises a pair of spaced arms which snap fit around the circumference of the tube 20 to be grasped. Most preferably, the holding mechanism 32 engages and grasps a tube 20 in some manner on an outside surface of the tube 20, moves laterally into and out of engagement with a tube 20 (i.e. lateral relative to the longitudinal axis of the tube 20) and is readily engageable with and disengageable from the tube 20.

Figure 4:
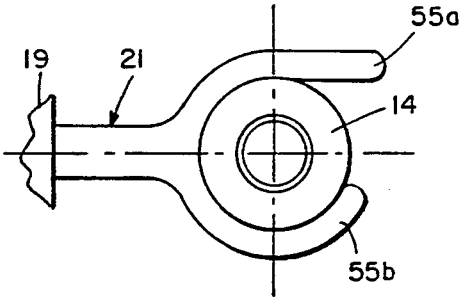
FIG. 4 is a top view of a gripping device for exchanging tubes shown in gripping engagement with a packaged tube.

FIG. 4 shows one embodiment of a suitable gripper 21 which has a hose shaped form with two limbs, 55*a*, 55*b*. The limbs may be stretched, e.g. limb 55*a*, via inputting air through the doffer rail 19. When the air is exhausted, the limbs 55 go back into a bent position as shown, for example, by 55*b*. An air intake might also be provided to change the position of the limbs 55 from a stretched position into a bent (or gripping) position. By providing deformable air inflatable/deflatable balloon or bag-like elements such as 55*a*, 55*b* for the gripping mechanism, empty tubes 20 and full packages 14 of varying diameter/thickness may all be sufficiently gripped without precise regard for the size of the tube or package.

As shown in FIGS. 1C–I, the gripping device 19 is positioned such that the gripping limbs 55*a*, 55*b* grip a tube 20 or package 14 at about the middle of the length of the tube 20 or package 14. Most preferably, the gripping limbs 55*a*, 55*b* are configured to grip a tube 20 of more specific or limited diameter. In such a preferred embodiment the stroke of the gripping mechanism 19 (and/or bearing plate 16) may be selected to align the gripping limbs 55*a*, 55*b* vertically relative to a package 14 (during the operation of FIGS. 1D–1G) such that the gripping limbs 55*a*, 55*b* will grip an empty tube portion 20 of a package 14, e.g. the empty tube portion 20 between the flange 44 and the threaded portion 14 of a packaged tube. Thus in such a preferred embodiment, provision need only be made in the gripping mechanisms 55*a*, 55*b* for gripping a tube of relatively specific diameter or other size, and even with such relatively limited gripping capability the grippers 19 may still both don, FIGS. 1A–1D and doff, FIGS. 1F–1I, empty and packaged tubes as described above.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. In a thread spinning machine, a method for exchanging a first empty thread receiving tube for a second thread receiving tube packaged with thread and mounted substantially vertically on a rotatable driven spindle on the spinning machine, wherein the thread packaged on the second tube extends continuously unbroken between the packaged tube and a mechanism for twisting the thread prior to exchange of the tubes, the method comprising the steps of:

positioning the first tube in coaxial alignment with and above the packaged tube and the spindle such that the thread extending between the packaged tube and the twisting mechanism remains unbroken during the positioning;

engaging the tubes together in coaxial alignment the tubes are rotatable together and readily detachable from each other;

a selected number of rotating the tubes together revolutions to wind the thread around the first tube a selected number of revolutions;

detaching the tubes and moving the second tube out of coaxial alignment with the first tube and the spindle such that the thread is broken between the first tube and the second tube; and placing the first tube on the spindle for subsequent spinning via the driven spindle.

2. The method of claim 1 wherein the step of positioning comprises maintaining the twisting mechanism vertically stationary, moving the packaged tubes vertically downward relative to the twisting mechanism a sufficient distance to enable the first tube to be moved into coaxial alignment with the packaged tube and moving the first tube into coaxial alignment with the packaged tube between the twisting mechanism and the packaged tube.

3. The method of claim 2 wherein the step of positioning further comprises unwinding the thread packaged on the packaged tube a sufficient amount during the course of moving the packaged tube vertically downward to at least prevent the continuous thread from breaking.

4. The method of claim 2 wherein the twisting mechanism comprises a cap mechanism mounted vertically stationary and is freely rotatable around a longitudinal axis of the cap mechanism.

5. The method of claim 1 wherein the step of detaching the tubes comprises gripping the first tube and holding the first tube vertically stationary, and subsequently gripping the packaged tube and moving the gripped packaged tube vertically downward at least until the tubes are detached from each other.

6. The method of claim 5 wherein the step of detaching the tubes further comprises moving the spindle vertically downward to a position below the gripped packaged tube in coaxial alignment with the first tube, moving the gripped packaged tube out of coaxial alignment with the first tube and the spindle, moving the spindle vertically upward to a position disposing the first tube on the spindle and releasing the gripped first tube such that the first tube is movable via movement of the spindle.

7. The method of claim 5 wherein the twisting mechanism comprises a cap mechanism mounted vertically stationary and is freely rotatable around a longitudinal axis of the cap mechanism.

8. The method of claim 1 wherein the spindle is mounted in a spindle bearing plate and connected to a motor means for drivable rotation of the spindle, the spindle and any tubes disposed on the spindles being vertically movable via vertical movement of the spindle bearing plate.

9. The method of claim 8 wherein the twisting mechanism comprises a cap mechanism mounted vertically stationary and is freely rotatable around a longitudinal axis of the cap mechanism.

10. The method of claim 1 wherein the twisting mechanism comprises a cap mechanism mounted vertically stationary and is freely rotatable around a longitudinal axis of the cap mechanism.

11. In a thread spinning machine, apparatus for exchanging first empty thread receiving tubes for second thread receiving tubes packaged with tread, comprising:

a substantially horizontally disposed spindle bearing plate mechanism on which is mounted a series of rotatably driven spindles for receiving and rotating tubes which are readily coaxially mountable thereon and readily coaxially removable therefrom;

means for controllably moving the spindle bearing plate in a vertical direction beneath a corresponding series of thread twisting mechanism, continuous threads extending between the twisting mechanisms and the packaged tubes mounted on the spindles;

means for controllably positioning a series of empty thread receiving tubes without breaking the continuous threads extending between the twisting mechanisms and the packaged tubes;

means for controllably placing the empty tubes on the packaged tubes on the spindles, the tubes being readily coaxially engageable and readily coaxially disengageable;

means for disengaging the packaged tubes from the tubes mounted thereon and removing the packaged tubes from coaxial alignment with the spindles, the threads extending between the packaged tubes and the empty tubes being broken upon operation of the means for disengaging and removing; and means for mounting the empty tubes on the spindles for subsequent spinning.

12. Apparatus of claim 11 wherein the means for disengaging and removing comprises a mechanism for holding a tube positioned on a packaged tube vertically stationary and means for gripping and pulling the packaged tube vertically downward to disengage the tubes.

13. Apparatus of claim 12 further comprising means for simultaneously moving the means for gripping and the spindle bearing plate mechanism vertically downward to disengage a packaged tube from a tube held stationary by the holding mechanism.

14. Apparatus of claim 11 wherein the twisting mechanisms comprise cap spinning mechanisms mounted vertically stationary on the machine, the holding mechanism being mounted so as to grasp and hold the tubes positioned on the packaged tubes at least partially within the cap mechanisms.

15. Apparatus of claim 11 wherein the means for controllably positioning, placing and disengaging comprises a series of gripping mechanisms movable laterally and vertically relative to the spindle bearing plate mechanism to position and place empty tubes on the packaged tubes and to disengage and remove packaged tubes out of coaxial alignment with the spindles.

16. In a thread spinning machine, a method for exchanging a first empty thread receiving tube for a second thread receiving tube packaged with read and mounted on a spindle wherein the thread packaged on the second tube extends continuously unbroken between the packaged tube and a mechanism for twisting the thread prior to exchange of the tubes, the method comprising:

positioning the first tube in coaxial alignment with and above the packaged tube such that the thread extending between the packaged tube and the twisting mechanism remains unbroken during the positioning;

engaging the tubes together in coaxial alignment with each other;

rotating the tubes together a selected number of revolutions to wind the thread around the first tube a selected number of revolutions;

moving the second tue downwardly out of engagement with the first tube and laterally out of coaxial alignment with the first tube such that the thread is broken between the first tube and the second tube;

placing the first tue on the spindle for subsequent spinning.

17. In a thread spinning machine a method for exchanging a first empty thread receiving tube for a second tube packaged with thread, the second tube being mounted in a thread spinning position on a spindle coaxially aligned with a mechanism for twisting the thread, the method comprising:

moving the spindle out of the spinning position coaxially downwardly relative to the twisting mechanism a distance sufficient to allow positioning of the first tube coaxially between the twisting mechanism and the second tube;

positioning the first tube coaxially between the second tube and the twisting mechanism and moving the first and second tubes into engagement with each other coaxially with the twisting mechanism;

moving the engaged tubes upwardly to position the first tube in the coaxial thread spinning position;

holding the first tube in the coaxial spinning position; and moving the second tube coaxially downwardly to detach the tubes.

18. In a thread spinning machine having a mechanism for twisting thread onto a thread receiving tube positioned in a spinning position in coaxial alignment with the twisting mechanism, apparatus for exchanging a first empty tube for a second tube packaged with thread comprising:

a spindle bearing plate on which is mounted a spindle coaxially aligned with the twisting mechanism, the second tube being mounted coaxially on the spindle in the thread spinning position;

means for controllably moving the spindle bearing plate vertically such that the spindle and the second tube are maintained in coaxial alignment with the twisting mechanism;

means for positioning the first tube coaxially between the second tube and the twisting mechanism;

means for engaging the first tube on the second tube coaxially with the twisting mechanism;

means for moving the first tube into the coaxial spinning position with the tubes engaged;

means for holding the first tube in the spinning position;

means for coaxially detaching the second tube from the first tube held in the coaxial spinning position; and means for removing the detached second tue out of coaxial alignment with the first tube and the twisting mechanism.

* * * * *